US011000116B2

(12) United States Patent
Bishop et al.

(10) Patent No.: US 11,000,116 B2
(45) **Date of Patent: *May 11, 2021**

(54) HAIR BRUSH

(71) Applicant: CONAIR CORPORATION, Stamford, CT (US)

(72) Inventors: Daniel Bishop, Monroe, CT (US); Duane Charles Hein, Monroe, CT (US); Elizabeth Luan Wei, Old Greenwich, CT (US); Jessica Anna Mikitovic, New Rochelle, NY (US)

(73) Assignee: Conair Corporation, Stamford, CT (US)

( * ) Notice: Subject to any disclaimer, the term of this patent is extended or adjusted under 35 U.S.C. 154(b) by 270 days.

This patent is subject to a terminal disclaimer.

(21) Appl. No.: 15/801,459

(22) Filed: Nov. 2, 2017

(65) Prior Publication Data

US 2019/0125066 A1 May 2, 2019

(51) Int. Cl.

| | |
|---|---|
| ***A46B 9/02*** | (2006.01) |
| ***A46B 11/00*** | (2006.01) |
| ***A46B 9/06*** | (2006.01) |

(52) U.S. Cl.

CPC ..... *A46B 11/0017* (2013.01); *A46B 9/023* (2013.01); *A46B 9/065* (2013.01); *A46B 11/0065* (2013.01); *A46B 11/0075* (2013.01)

(58) Field of Classification Search

CPC ..... A46B 11/0017; A46B 11/0065; A46B 11/0075; A46B 11/002; A46B 9/023;

(Continued)

(56) References Cited

U.S. PATENT DOCUMENTS 2,238,603 A * 4/1941 Runnels ..... A45D 24/16 132/120
3,140,499 A * 7/1964 Du Bois ..... A46B 5/00 15/160

(Continued)

FOREIGN PATENT DOCUMENTS

KR 1666983 * 10/2016 ..... A46B 5/0025
WO WO-8001135 A1 * 6/1980 ..... A46B 1/00

(Continued)

*Primary Examiner* — Jacqueline T Johanas
*Assistant Examiner* — Thomas Drew Agger
(74) *Attorney, Agent, or Firm* — Lawrence Cruz, Esq.; Ryan, Mason & Lewis, LLP

(57) ABSTRACT

A hair brush includes a handle defining a longitudinal axis and a brush head having at least two longitudinal primary arms extending longitudinally from the handle and disposed in lateral spaced relation to define a longitudinal gap therebetween. Each of the longitudinal primary arms includes a pair of longitudinal rear spines disposed in lateral spaced relation, a single longitudinal intermediate spine extending from the rear spines, and a pair of longitudinal forward spines disposed in lateral spaced relation and extending from the intermediate spine. Hair engaging bristles are disposed on each of the rear spines, the intermediate spines and the forward spines. The at least two longitudinal primary arms are substantially flexible to conform to the contour of the user's head. A container containing a hair treatment agent such as dry shampoo may be releasably mounted to the handle.

18 Claims, 6 Drawing Sheets

(58) Field of Classification Search

CPC .. A46B 9/065; A46B 9/02; A46B 9/06; A46B 9/005; A46B 7/08; A46B 7/02; A46B 7/06; A46B 2200/104; A46B 2200/20; A46B 2200/1046; A46B 1/00; A46B 5/0033; A46B 15/003; A46B 17/04; A46B 5/0025; A45D 24/00; A45D 24/26; A45D 24/10; A45D 24/22; A45D 24/02; A45D 24/04; A45D 24/30; A45D 2024/002; A45D 19/00; A45D 2019/005; A45D 40/262; A45D 2200/057; A45D 2200/152; A45D 2200/1018; A45D 2/001; A45D 2/002; A45D 20/48; A46D 1/00; A46D 1/0238; A46D 1/0284; A01K 13/002

USPC ..... 132/148, 290, 219, 120, 126, 142, 161, 132/112, 220, 229; 15/201, 160, 186, 15/187, 207.2, 167.1, 169; D4/132, 134, D4/130, 114, 100, 116, 117, 136, 138; 401/266, 265, 261, 137, 138, 268, 190; D28/20, 25, 7, 9, 13, 21, 22, 24, 30, 31, D28/63; 119/625, 604, 611, 603, 602

See application file for complete search history.

(56) References Cited

U.S. PATENT DOCUMENTS

| | | | | |
|---|---|---|---|---|
| 3,406,694 | A | 10/1968 | Odence | |
| 3,516,424 | A | 6/1970 | Eagle | |
| 3,636,963 | A | 1/1972 | Olson | |
| 3,668,732 | A * | 6/1972 | Lardenois | A46B 9/023 15/207.2 |
| 3,960,160 | A | 6/1976 | Hogan | |
| 4,289,153 | A | 9/1981 | Paccione | |
| D270,427 | S | 9/1983 | Henington | |
| 4,475,563 | A * | 10/1984 | Martin | A45D 2/00 132/136 |
| D279,648 | S | 7/1985 | Fini | |
| 4,557,619 | A | 12/1985 | DeVincentis | |
| D283,650 | S | 4/1986 | Smith | |
| D306,523 | S | 3/1990 | Natali et al. | |
| D309,529 | S | 7/1990 | Kim | |
| D310,601 | S | 9/1990 | Byriel | |
| D318,180 | S | 7/1991 | Yip Kai-Wing | |
| 5,193,557 | A | 3/1993 | Hogan | |
| 5,449,006 | A | 9/1995 | Hogan et al. | |
| 5,524,648 | A | 6/1996 | Colon et al. | |
| 5,622,192 | A | 4/1997 | Chiou | |
| D385,657 | S | 10/1997 | Ostlund | |
| 5,746,531 | A | 5/1998 | Izhak | |
| 5,909,737 | A | 6/1999 | Ricco | |
| 5,913,314 | A | 6/1999 | Garrett | |
| 5,947,130 | A | 9/1999 | Musum | |
| 6,308,717 | B1 * | 10/2001 | Vrtaric | A46B 9/023 132/129 |
| 6,325,070 | B1 | 12/2001 | Tyroler et al. | |
| 6,378,529 | B1 | 4/2002 | Clemente Marco | |
| D459,027 | S | 6/2002 | Chen et al. | |
| 6,675,812 | B1 | 1/2004 | Wiley | |
| D490,564 | S | 5/2004 | Colacioppo et al. | |
| 6,976,495 | B2 | 12/2005 | Vena et al. | |
| 7,011,468 | B1 | 3/2006 | Leventhal | |
| 7,234,472 | B2 | 6/2007 | Ramet | |
| 7,246,573 | B2 | 7/2007 | Dunn et al. | |
| 7,309,182 | B2 * | 12/2007 | McKay | A01K 13/002 132/313 |
| D593,710 | S | 6/2009 | Wise et al. | |
| D615,703 | S * | 5/2010 | Hsu | D28/40 |
| 7,748,391 | B2 | 7/2010 | Vance | |
| D721,506 | S | 1/2015 | Schuler | |
| 8,939,158 | B2 | 1/2015 | Mercier et al. | |
| 9,004,797 | B2 | 4/2015 | Watson | |
| D739,660 | S * | 9/2015 | Rennette | D4/138 |
| 9,247,805 | B1 | 2/2016 | Malm | |
| D750,896 | S * | 3/2016 | Park | D4/136 |
| 9,427,060 | B2 | 4/2016 | Mercier | |
| D838,495 | S * | 1/2019 | Li | D4/134 |
| D843,115 | S * | 3/2019 | Bishop | D4/100 |
| 2002/0153020 | A1 | 10/2002 | Fiore | |
| 2005/0063764 | A1 * | 3/2005 | McKay | A01K 13/002 401/138 |
| 2007/0113865 | A1 | 5/2007 | Kresley et al. | |
| 2008/0017217 | A1 * | 1/2008 | Leung | A45D 20/525 132/313 |
| 2012/0138088 | A1 | 6/2012 | Tumale | |
| 2014/0209113 | A1 | 7/2014 | Turcott | |
| 2017/0231360 | A1 * | 8/2017 | Cambra | A45D 24/22 132/200 |

FOREIGN PATENT DOCUMENTS

| | | | |
|---|---|---|---|
| WO | WO-2015128002 A1 * | 9/2015 | A46B 5/0012 |
| WO | WO2016089803 | 6/2016 | |

* cited by examiner

HAIR BRUSH

BACKGROUND

1. Technical Field

The present disclosure relates to a hair brush, and in particular, relates to a hair brush for use with a hair treatment agent. The present disclosure further relates to a hair brush with a mounted dry shampoo container and having a brush head readily adaptable to the contours of the user's head to effectively distribute the shampoo while incorporating flow passages to facilitate removal of moisture, oils, etc. from the hair.

2. Discussion of Related Art

Hair brushes or combs for application of a hair treatment agent such as dry shampoo are known in the art. Typically, these hair brushes or combs include a continuous head from which depends a plurality of teeth or bristles utilized to distribute the dry shampoo within the user's hair. However, these devices have proven ineffective for their intended uses. For example, the continuous head often restricts flow of the dry shampoo from the scalp during the combing process while also trapping moisture and/or oils adjacent the scalp thereby inhibiting the cleaning effects of the dry shampoo. In addition, the continuous head of known devices lacks the flexibility to follow the contours of the user's head and thus fails to adequately distribute the dry shampoo into the user's scalp.

SUMMARY

Accordingly, the present disclosure addresses the disadvantages associated with known hair brushes, particularly, hair brushes utilized in applying dry shampoo. In accordance with one exemplary embodiment, a hair brush for use with, e.g., a hair treatment agent such as dry shampoo is disclosed. The hair brush includes a handle defining a longitudinal axis and a brush head having at least two longitudinal primary arms extending longitudinally from the handle and disposed in lateral spaced relation to define a longitudinal gap therebetween. Each of the longitudinal primary arms includes a pair of longitudinal rear spines disposed in lateral spaced relation, a single longitudinal intermediate spine extending from the rear spines, and a pair of longitudinal forward spines disposed in lateral spaced relation and extending from the intermediate spine. Hair engaging bristles are disposed on each of the rear spines, the intermediate spines and the forward spines. In one embodiment, each of the at least two longitudinal primary arms are substantially flexible, and are configured for movement with respect to the longitudinal axis.

The rear spines of each of the longitudinal primary arms may define a slotted opening therebetween and the forward spines of each of the longitudinal primary arms may define a slotted opening therebetween. Each rear spine, intermediate spine and forward spine may include a single longitudinal row of bristles. At least some of the bristles of the rear spines, the intermediate spines and the forward spines have a plurality of tufts at least partially circumscribing respective individual bristles.

In one embodiment, the brush head includes three longitudinal primary arms arranged in lateral spaced relation whereby adjacent longitudinal primary arms define the longitudinal gap therebetween.

The brush head may define a radius of curvature when viewed in side elevation.

A container may be mountable to the handle, and have a hair treatment agent therein. The container may include a fluid outlet which is disposed in longitudinal opposed relation to the brush head when mounted to the handle. The hair treatment agent may include dry shampoo.

The hair brush of the present disclosure provides a flexible brush head having a plurality of independent longitudinal primary arms capable of flexing movement relative to each other and to the longitudinal axis of the hair brush. The longitudinal primary arms are spaced from each other such that the brush head is discontinuous, unlike conventional brushes, thereby providing gaps therebetween to provide release of moisture, oil, air and/or facilitate circulation of shampoo within the hair. The longitudinal primary arms also incorporate spaced spines with hair engaging bristles which engage to comb hair and remove the shampoo from the hair. The spaced arrangement of the spines also facilitates removal of oil, moisture etc. while providing passages for distribution of the shampoo within the hair.

Other features of the present disclosure will be appreciated from the following description of same.

BRIEF DESCRIPTION OF THE DRAWINGS

Various embodiments of the present disclosure are described hereinbelow with references to the drawings, wherein.

DETAILED DESCRIPTION

Figure 1:
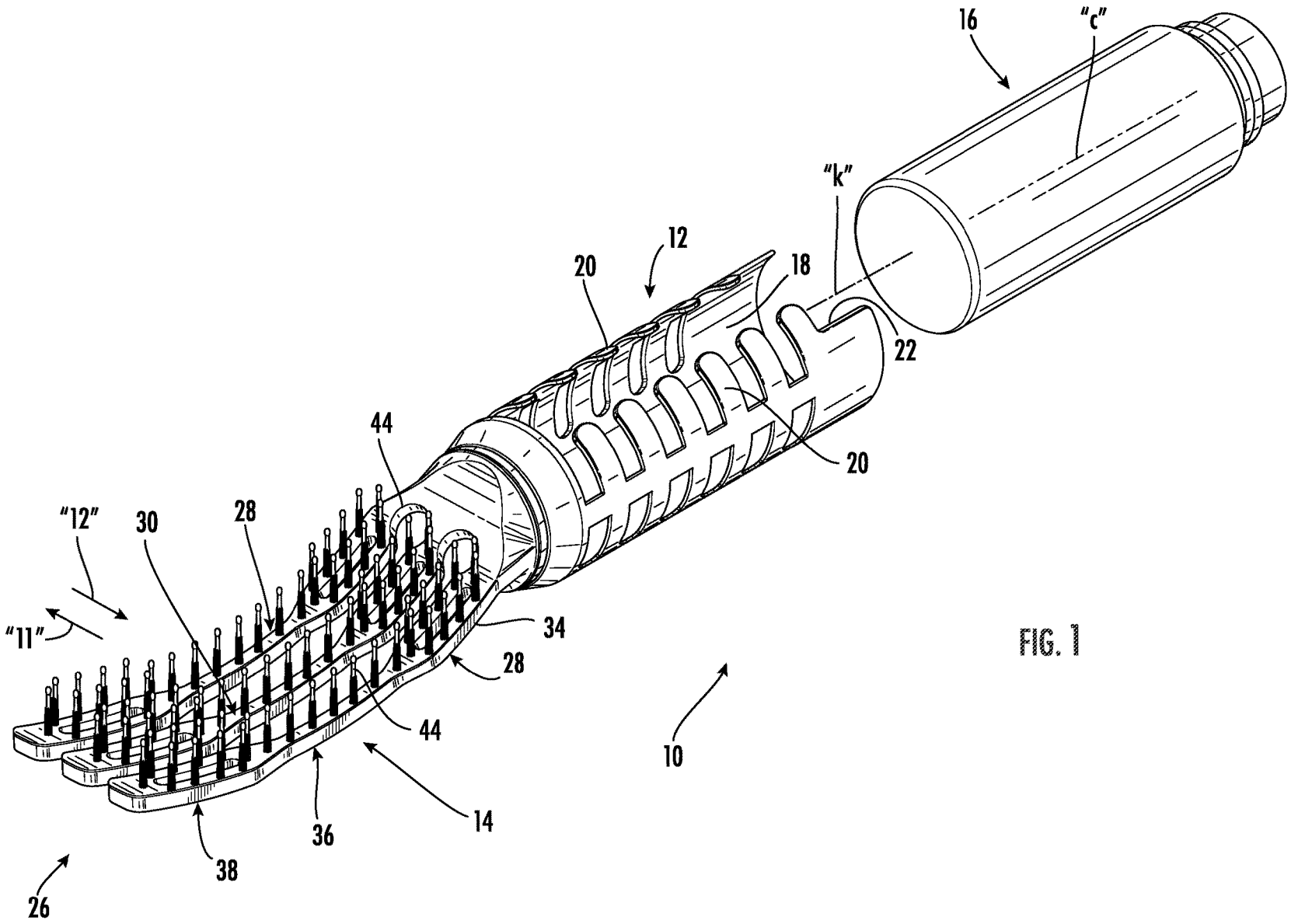
FIG. 1 is a perspective view of the hair brush in accordance with the principles of the present disclosure illustrating the handle, the brush head and the container with a hair treatment agent therein and depicted separated from the handle.

Referring now to the drawing figures wherein like reference numerals identify similar or like components throughout the several views, FIGS. 1-4 illustrate the hair brush in accordance with the principles of the present disclosure. The hair brush is contemplated for use with a hair treatment agent, e.g., dry shampoo, to facilitate application of the dry shampoo throughout the user's hair while also enhancing removal of moisture, oils etc. from the hair. The hair brush is characterized by being substantially flexible to conform to the user's head during application to thoroughly distribute the shampoo throughout the length of the user's hair while also providing flow passages though the brush head such that air is circulated through the brush head to effectively remove moisture, oil and/or dry the shampoo.

The hair brush 10 includes a handle 12 defining a longitudinal axis "k", a brush head 14 extending from the handle 12 and, optionally, a container 16 containing a hair treatment agent which is releasably mountable relative to the handle 12. The handle 12 may define a plurality of configurations.

In one embodiment, the handle 12 defines an internal chamber 18 dimensioned for at least partial reception of the container 16 in frictional relation therewith whereby the container 16 is releasably mountable to the handle 12. The internal chamber 18 of the handle 12 may be circular in cross-section and may be defined at least in part by a plurality of spaced ribs 20 orthogonally arranged with respect to the longitudinal axis "k". The ribs 20 may deflect radially outwardly to receive the container 16 and then return under their inherent respective resiliencies toward their normal positions to engage the container 16 in frictional relation therewith. Other mechanisms for mounting the container 16 relative to the handle 12 are also envisioned including a snap lock fit, bayonet coupling or the like. The handle 12 further includes diametrically opposed first and second recesses 22, 24 adjacent its rear end. The recesses 22, 24 cooperate with the container 16 to facilitate release of the contents of the container 16 as will be discussed.

Figure 3:
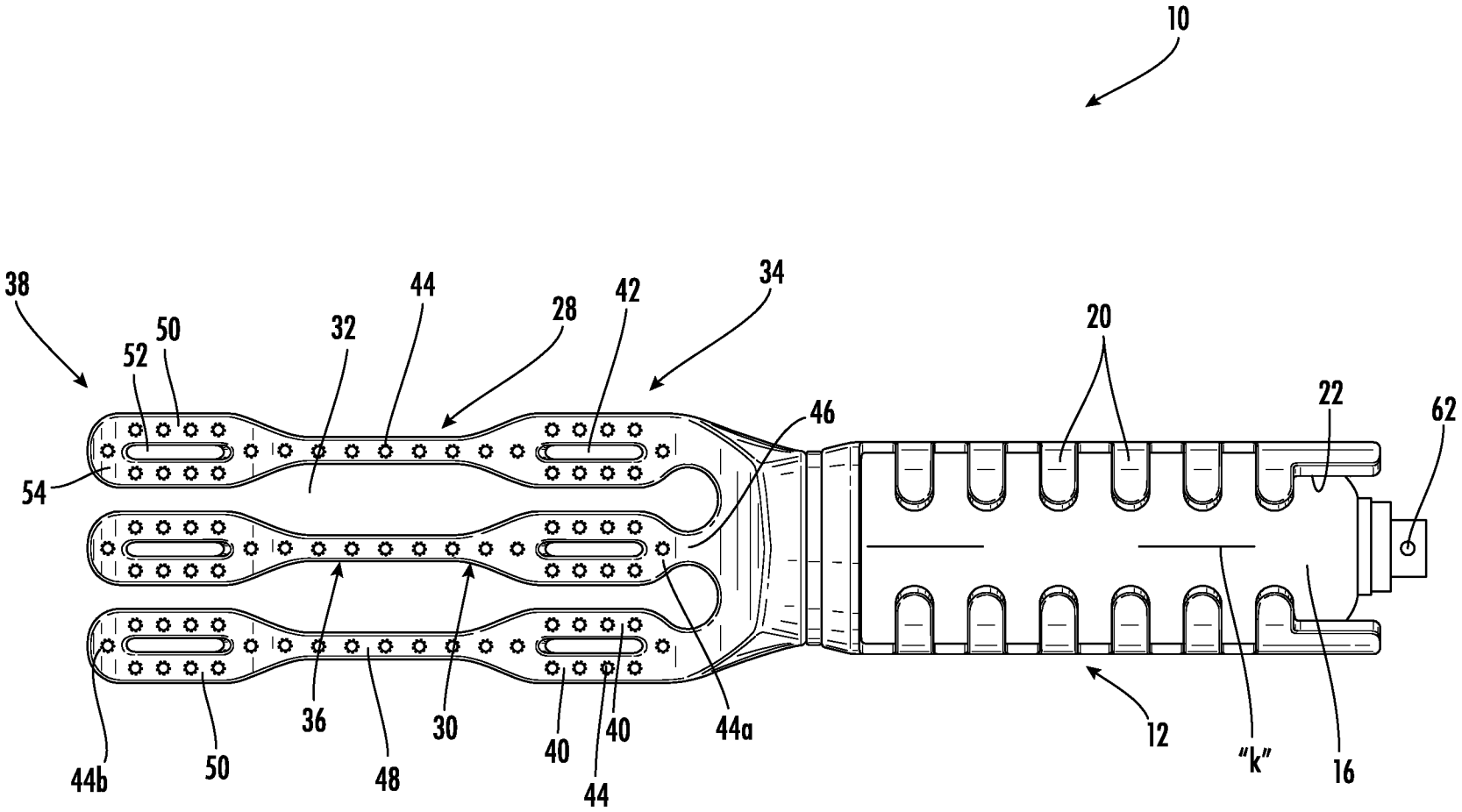
FIG. 3 is a top plan view of the hair brush with mounted container.
Figure 4:
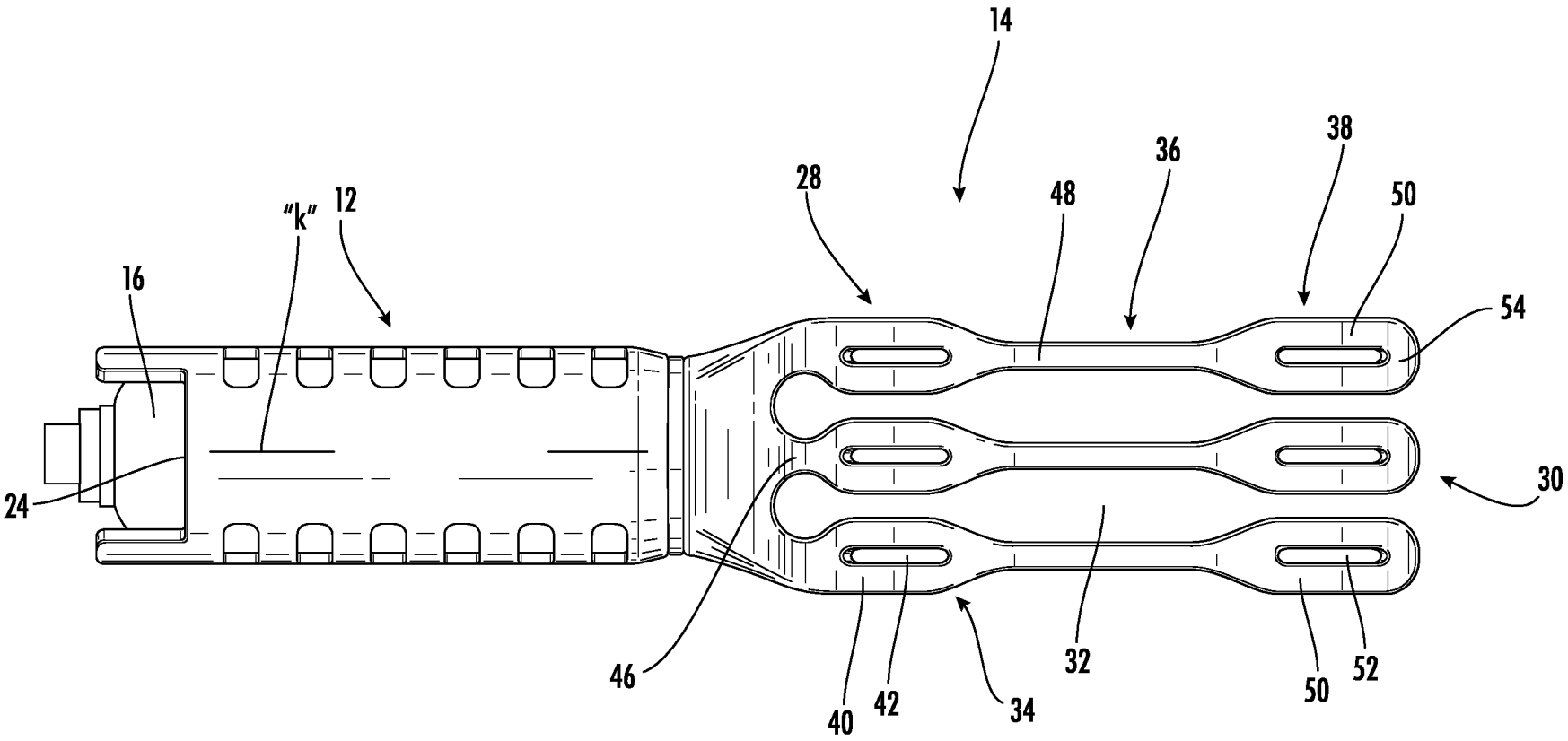
FIG. 4 is a bottom plan view of the hair brush with mounted container.

The brush head 14 extends from the handle 12 and may be monolithically formed with the handle 12. The brush head 14 includes a plurality of longitudinal primary arms extending along the longitudinal axis "k". In an embodiment, the brush head 14 includes three longitudinal primary arms 28, 30, e.g., first and second outer arms 28 disposed in general parallel relation with the longitudinal axis "k", and a central longitudinal primary arm 30 which may be parallel to, and/or coincident with, the longitudinal axis "k". More or less than three longitudinal primary arms 28, 30 are also envisioned. In the alternative, the longitudinal primary arms 28, 30 may be obliquely arranged with respect to the longitudinal axis "k". As best depicted in FIGS. 3-4, the longitudinal primary arms 28, 30 are arranged whereby adjacent longitudinal primary arms 28, 30 are in lateral spaced relation with respect to the longitudinal axis "k" to define longitudinal slots or gaps 32 between the adjacent longitudinal primary arms 28, 30. The longitudinal gaps 32 permit circulation of air through the brush head 14 during utilization with, e.g., dry shampoo, to facilitate release of moisture, oils etc. from the hair and/or drying of the shampoo. The longitudinal gaps 32 also permit flow of the dry shampoo through the brush head 14 to facilitate distribution of the shampoo through the length of hair.

With continued reference to FIGS. 3-4, each longitudinal primary arm 28, 30 includes a rear arm segment 34 adjacent the handle 12, an intermediate arm segment 36, and a forward arm segment 38 remote from the handle 12. Each rear arm segment 34 includes a pair of rear spines 40 extending along the longitudinal axis "k" and disposed in lateral spaced relation to define a slotted opening 42 therebetween. Each rear spine 40 includes hair engaging bristles 44 extending radially therefrom. The bristles 44 of each rear spine 40 may include a single longitudinal row of bristles in longitudinal alignment with each other and parallel to the longitudinal axis "k". The rear arm segment 34 may further include a rear end 46 adjacent the handle 12 and having a single bristle 44*a* which is longitudinally offset with the bristles 44 of the rear spines 40. The slotted openings 42 between the adjacent rear spines 40 each provide a passage to permit circulation of air to facilitate removal of oil and/or moisture from the hair. The slotted openings 42 also permit flow of the hair treatment agent, e.g., dry shampoo, therethrough to facilitate distribution of the dry shampoo along the scalp area and along the length of the hair.

The intermediate arm segment 36 of each longitudinal primary arm 28, 30 includes a single intermediate spine 48 coterminous with the rear spines 40 of the rear arm segment 34. The intermediate spine 48 also includes a plurality of intermediate bristles 44, which may be arranged in longitudinal alignment with themselves and with respect to the longitudinal axis "k". The bristles 44 of the intermediate arm segment 36 are offset with respect to the bristles 44 on the rear spines 40 of the rear arm segment 34, e.g., the bristles 44 of the intermediate spine 48 may longitudinally bisect the rear spines 40. The bristles 44 of the intermediate spine 48 may be in longitudinal alignment with the single bristle 44*a* of the rear end 46 of the rear arm segment 34.

The forward arm segment 38 is substantially similar to the rear arm segment 34. The forward arm segment 38 includes a pair of forward spines 50 extending along the longitudinal axis "k" and disposed in lateral spaced relation to define a slotted opening 52 therebetween. The slotted openings 52 function in a similar manner to the slotted openings 42 of the rear arm segment 34 to facilitate air circulation and removal of oil, moisture, etc. from the user's hair and/or distribution of the treatment agent through the length of the hair and the scalp area. Each forward spine 50 includes hair engaging bristles 44 extending radially therefrom where the bristles 44 of each forward spine 50 includes a single longitudinal row of bristles 44 in longitudinal alignment with each other. In an embodiment, the bristles 44 of the forward spines 50 are in general longitudinal alignment with respective bristles 44 of the rear spines 40 of the rear arm segment 34. The forward end segment 38 may further include a forward end 54 remote from the handle 12 and having a single bristle 44*b* in general alignment with the bristles 44 of the intermediate arm segment 36 and with the single bristle 44*a* of the rear end 46 of the rear arm segment 34.

The lateral spacing of the longitudinal primary arms 28, 30 in combination with the multiple spine and single spine configuration of the rear and forward end segments 34, 38 and the intermediate arm segment 36, respectively, provides a brush head 14 which is substantially flexible to be readily capable to conform to the user's head during use. For example, as best depicted in FIG. 1, the longitudinal primary arms 28, 30 may flex in a multitude of directions, including, e.g. in lateral directions "l1", "l2" with respect to the longitudinal axis "k", during application to the user's head. The longitudinal primary arms 28, 30 may flex independent of each other.

Figure 2:
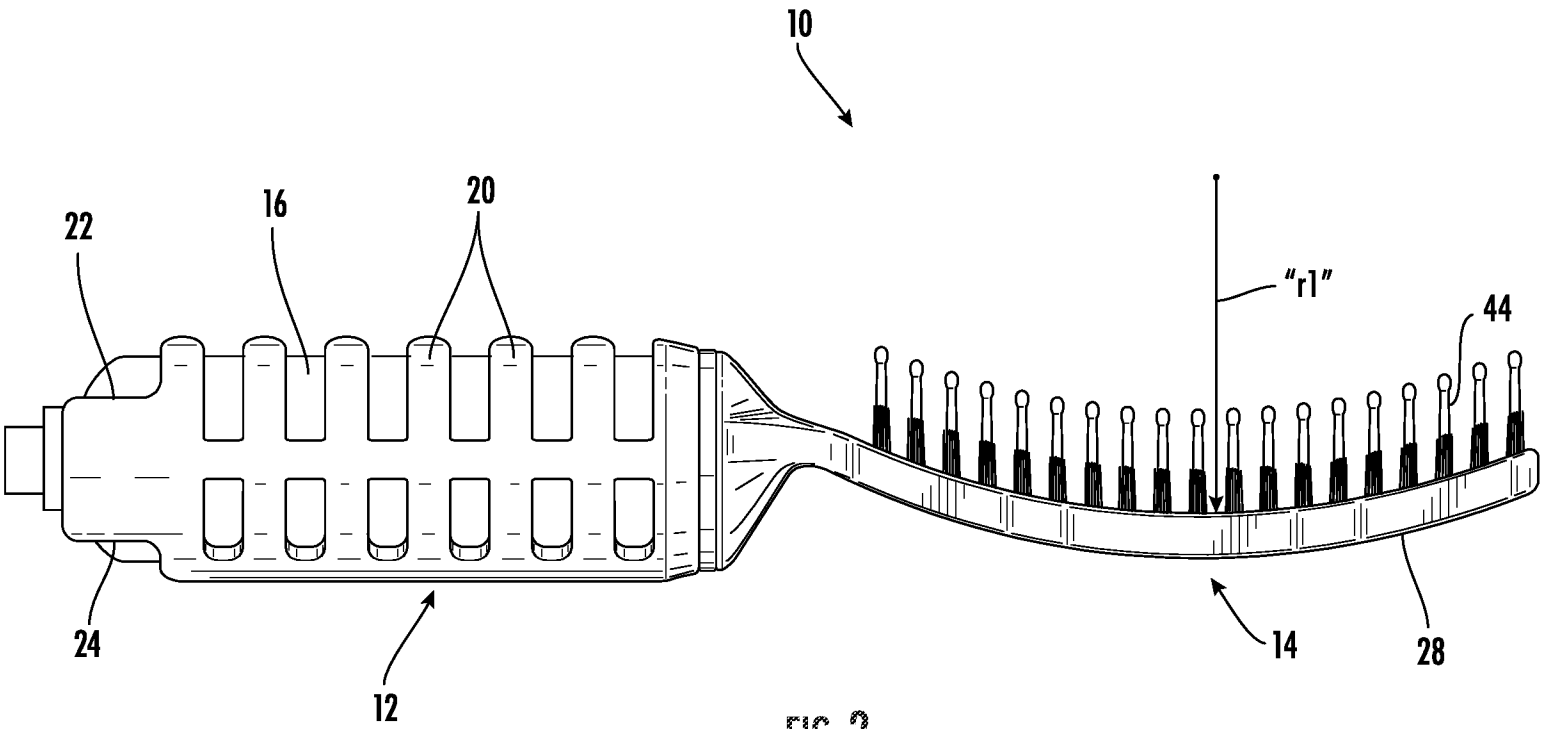
FIG. 2 is a side elevation view of the hair brush with the container mounted thereto.
Figure 5:
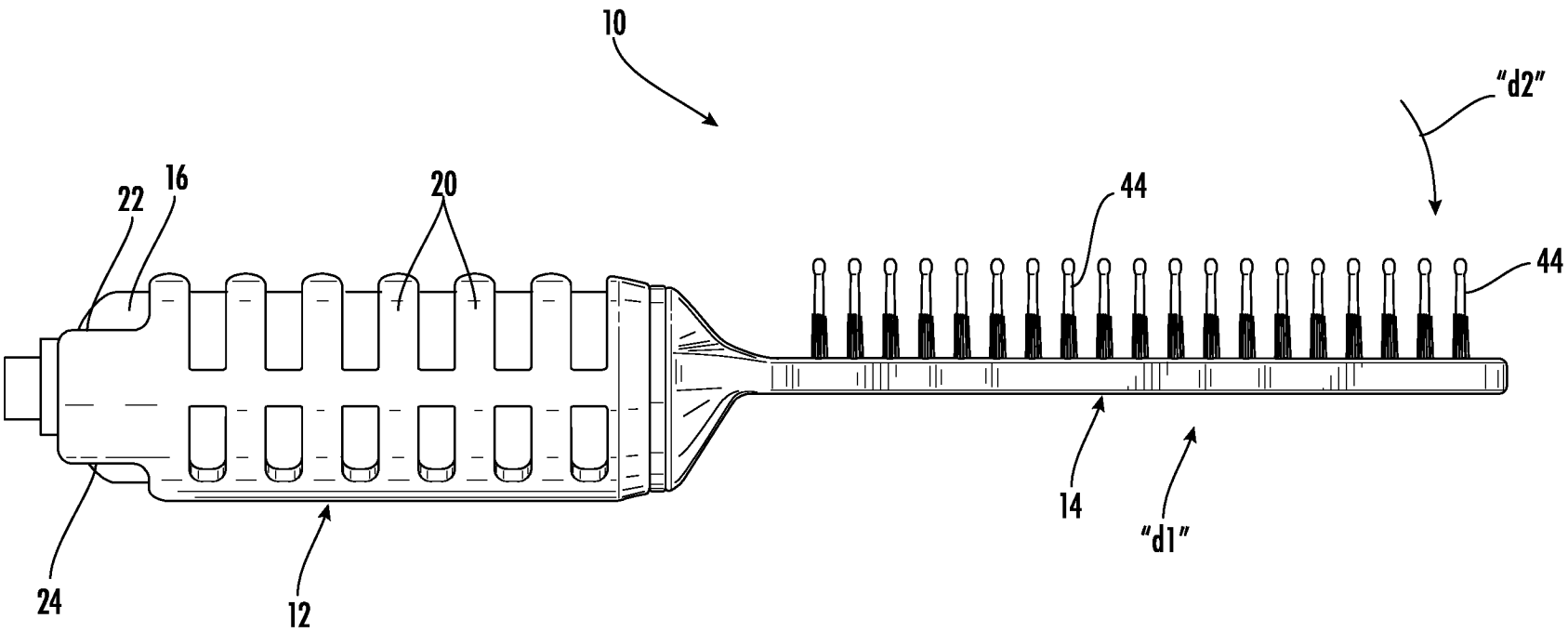
FIG. 5 is a side elevation view similar to the view of FIG. 2 illustrating the brush head of the hair brush flexing to assume a general linear configuration.

In addition, with continued reference to FIG. 2, the longitudinal primary arms 28, 30 are arranged to define a radius of curvature "r1". The radius of curvature "r1" is selected to generally conform to the curvature of the user's head to maximize contact with the scalp when the brush head 14 is in an initial unstressed condition. As best depicted in FIG. 5, in conjunction with FIG. 2, during application to, or when pressed against, the user's head and scalp, the longitudinal primary arms 28, 30 may flex radially, in either of the directions "d1", "d2" toward a general linear configuration and/or configurations therebetween (FIG. 5). This enhances application of the hair treatment agent, e.g., dry shampoo, within areas of the user's hair adjacent the scalp, e.g., roots of hair, and outwardly therefrom to ensure the treatment agent is adequately distributed through the user's hair. The longitudinal primary arms 28, 30 may flex in this direction independent of each other.

Figure 6:
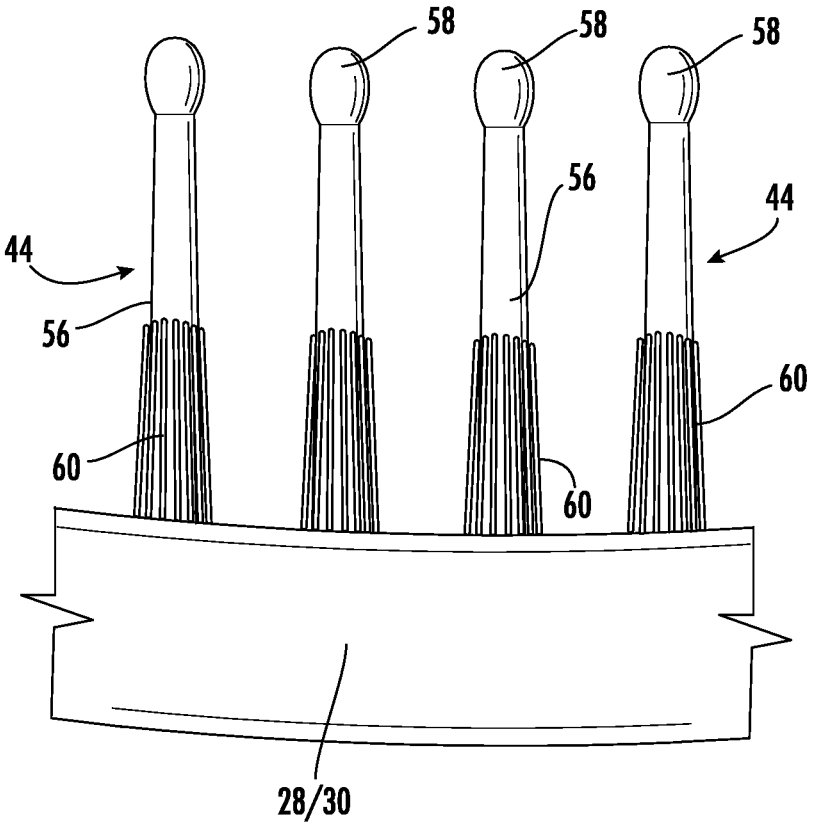
FIG. 6 is an enlarged isolated view of the individual bristles of the brush head.

FIG. 6 illustrates the individual bristles 44 of each of the rear arm segment 34, the intermediate arm segment 36 and the forward arm segment 38 of the longitudinal primary arms 28, 30. Each bristle 44 includes a generally conical base 56 and a rounded head 58 at its remote end. The bristles 44 may be substantially flexible to also conform to the user's head during application and use of the hair brush 10. In the alternative, the bristles 44 may be relatively rigid. Each bristle 44 may have a plurality of tufts 60 at least partially circumscribing the base 56 of the bristle 44. The tufts 60 are substantially flexible, e.g., in one embodiment, the tufts 60 are more flexible than the bristles 44. The tufts 60 increase the effective surface area of the bristles 44, and thus assist in distribution of the dry shampoo by capturing the dry shampoo as the hair brush 10 is drawn through the user's hair.

With reference again to FIGS. 1-4, the container 16 of the hair brush 10 may be a pressurized aerosol container having a cross-section, e.g., circular, configured to be received within the internal chamber 18 of the handle 12 in frictional relation therewith. In one embodiment, the container 16 is mounted such that the fluid outlet or nozzle 62 is disposed adjacent the rear end of the handle 12 remote from or opposed to the brush head 14. The container 16 is mounted such that an axis "c" of the container is generally parallel to, or coincident with, the longitudinal axis "k". The nozzle 62 may be positioned adjacent the first recess 22 of the handle 12 to direct the contents in an orthogonal direction with respect to the longitudinal axis "k" (FIG. 3). Access to the nozzle 62 for engagement by the user's finger is established via the opposed second recess 24 in the handle 12 (FIG. 4). Thus, the user may selectively spray contents of the container 16 onto the hair without removing the container 16 from the handle 12. The container 16 may include any type of hair treatment agent including dry shampoo, hair spray, mousse, coloring agents etc. In one embodiment, the container contains dry shampoo, and is pressurized such that the dry shampoo is distributed to the hair under pressure.

The handle 12 and the brush head 14 may be monolithically formed of a suitable polymeric material. In one embodiment, the selected material exhibits some flexibility and resiliency such that the longitudinal primary arms 28, 30 may displace during application of the brush head 14 against the head and then return to its normal unstressed condition upon removal of application forces. Suitable materials include ABS, polyester (e.g., Nylon), polycarbonate, polyethylene, polymethylmethacrylate, polypropylene, polyurethane, polyvinylchloride, PEEK, a fluorocarbon (e.g., PTFE), a vinyl ester and combinations thereof. Other materials are also envisioned.

The use of the hair brush 10 will now be discussed. When it is desired to treat the user's hair, e.g., wash the hair with dry shampoo, the container 16 containing dry shampoo is mounted within the internal chamber 18 of the handle 12. The dry shampoo is thoroughly applied to the user's hair by activation of the fluid nozzle 62 of the container 16. A large volume of the dry shampoo is preferably applied adjacent the user's scalp. The dry shampoo may be worked into the hair with the user's fingers if desired. Thereafter, the brush head 14 is applied against the user's head and the brush head 14 is pulled through the hair in a direction away from the scalp. This process is continued a number of times. During application of the brush head 14, the longitudinal primary arms 28, 30 may flex to follow the contour of the user's head working the shampoo into the hair. The longitudinal gaps 32 between the longitudinal primary arms 28, 30 and the slotted openings 42, 52 between the rear and forward spines 40, 50 facilitate distribution of the dry shampoo through the length of the hair and the scalp area. In addition, air is circulated through the longitudinal gaps 32 and through the slotted openings 42, 52 of the rear and forward spines 40, 50 to provide sufficient air flow to effectively and efficiently release moisture, oils etc., from the hair.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A hair brush, which comprises:

a handle defining a longitudinal axis; and a brush head including at least two individual longitudinal primary arms extending longitudinally from said handle and disposed in lateral spaced relation to define a longitudinal gap therebetween along entire longitudinal lengths of said longitudinal primary arms, each said longitudinal primary arm including:

a pair of longitudinal rear spines disposed in lateral spaced relation, each said longitudinal rear spine including a plurality of bristles;

a single longitudinal intermediate spine extending from said rear spines, said longitudinal intermediate spine including a plurality of bristles; and a pair of longitudinal forward spines disposed in lateral spaced relation and extending from said intermediate spine, each said longitudinal forward spine including a plurality of bristles;

wherein said pair of rear spines of each said individual longitudinal primary arm defines a slotted opening therebetween and said pair of forward spines of each said individual longitudinal primary arm defines a slotted opening therebetween;

wherein a width of said longitudinal gap between said longitudinal primary arms varies along said longitudinal axis; and wherein a width of said longitudinal gap between respective intermediate spines of adjacent longitudinal primary arms of said at least two individual longitudinal primary arms is greater than a width of said longitudinal gap between respective pairs of longitudinal rear spines of said adjacent longitudinal primary arms and is greater than a width of said longitudinal gap between respective pairs of longitudinal forward spines of said adjacent longitudinal primary arms.

2. The hair brush according to claim 1 wherein each of said at least two individual longitudinal primary arms are flexible, and are configured for movement with respect to said longitudinal axis.

3. The hair brush according to claim 1 wherein said rear spines of each said individual longitudinal primary arm define a single slotted opening therebetween and said forward spines of each said individual longitudinal primary arm define a single slotted opening therebetween.

4. The hair brush according to claim 3 wherein each said rear spine includes a single longitudinal row of said bristles.

5. The hair brush according to claim 4 wherein each said intermediate spine includes a single longitudinal row of said bristles.

6. The hair brush according to claim 5 wherein each said forward spine includes a single longitudinal row of said bristles.

7. The hair brush according to claim 3 wherein said brush head includes first, second and third individual longitudinal primary arms arranged in lateral spaced relation whereby adjacent longitudinal primary arms define said longitudinal gap therebetween; and wherein a width of said longitudinal gap between respective intermediate spines of adjacent second and third longitudinal primary arms is greater than a width of said longitudinal gap between respective pairs of longitudinal rear spines of said adjacent second and third longitudinal primary arms and is greater than a width of said longitudinal gap between respective pairs of longitudinal forward spines of said adjacent second and third longitudinal primary arms.

8. The hair brush according to claim 7 wherein said first, second and third longitudinal primary arms each define a forward end remote from said handle, said forward ends of each said three longitudinal arms being free from connection to any other of said forward ends of said three longitudinal arms.

9. The hair brush according to claim 3 wherein:

said slotted opening defined by said rear spines of each said individual longitudinal primary arm is elongated with respect to the longitudinal axis; and said slotted opening defined by said forward rear spines of each said individual longitudinal primary arm is elongated with respect to the longitudinal axis.

10. The hair brush according to claim 1 wherein said brush head defines a radius of curvature when viewed in side elevation.

11. The hair brush according to claim 1 wherein a given number of said bristles of said rear spines, said intermediate spines and said forward spine have a plurality of tufts surrounding respective individual bristles.

12. The hair brush according to claim 1 including a container mountable to said handle, said container including a hair treatment agent therein.

13. The hair brush according to claim 12 wherein said container includes a fluid outlet, said fluid outlet disposed in longitudinal opposed relation to said brush head when mounted to said handle.

14. The hair brush according to claim 1 wherein said at least two individual longitudinal primary arms each define a forward end remote from said handle and adjacent respective pairs of longitudinal forward spines, said forward ends of each said at least two individual longitudinal primary arms being free from connection to any other of said forward ends of said at least two individual longitudinal arms.

15. A hair brush, which comprises:

a handle defining a longitudinal axis; and a brush head including at least two individual longitudinal primary arms extending longitudinally from said handle and disposed in lateral spaced relation to define a longitudinal gap therebetween along entire longitudinal lengths of said longitudinal primary arms, each said longitudinal primary arm including:

a pair of longitudinal rear spines disposed in lateral spaced relation, each said longitudinal rear spine including a plurality of bristles;

a single longitudinal intermediate spine extending from said rear spines, said longitudinal intermediate spine including a plurality of bristles; and a pair of longitudinal forward spines disposed in lateral spaced relation and extending from said intermediate spine, each said longitudinal forward spine including a plurality of bristles;

wherein said pair of rear spines of each said individual longitudinal primary arm defines a slotted opening therebetween and said pair of forward spines of each said individual longitudinal primary arm defines a slotted opening therebetween;

wherein a width of said longitudinal gap between said longitudinal primary arms varies along said longitudinal axis; and wherein a width of said longitudinal gap between respective intermediate spines of adjacent longitudinal primary arms of said at least two individual longitudinal primary arms is greater than a width of said longitudinal gap between respective pairs of longitudinal rear spines of said adjacent longitudinal primary arms and is greater than a width of said longitudinal gap between respective pairs of longitudinal forward spines of said adjacent longitudinal primary arms; and further including a container mountable to said handle, said container including a hair treatment agent therein, wherein said hair treatment agent includes dry shampoo disposed within said container under pressure.

16. A hair brush, which comprises:

a handle defining a longitudinal axis; and a brush head including a plurality of individual longitudinal primary arms extending longitudinally from said handle and disposed in lateral spaced relation to define a longitudinal gap between adjacent individual longitudinal primary arms, said individual longitudinal primary arms being flexible independent of each other, each said individual longitudinal primary arm including:

a pair of longitudinal rear spines disposed in lateral spaced relation and separated by an elongated slot, each said longitudinal rear spine including a plurality of longitudinally aligned bristles;

a single longitudinal intermediate spine extending from said rear spines, said longitudinal intermediate spine including a plurality of longitudinally aligned bristles;

a pair of longitudinal forward spines disposed in lateral spaced relation and separated by an elongated slot, and extending from said intermediate spine, each said longitudinal forward spine including a plurality of longitudinally aligned bristles;

wherein a width of said longitudinal gap between said longitudinal primary arms varies along said longitudinal axis; and wherein a width of said longitudinal gap between respective intermediate spines of adjacent individual longitudinal primary arms is greater than a width of said longitudinal gap between respective pairs of longitudinal rear spines of said adjacent longitudinal primary arms and is greater than a width of said longitudinal gap between respective pairs of longitudinal forward spines of said adjacent longitudinal primary arms.

17. The hair brush according to claim 16 wherein said longitudinal gap between said adjacent individual longitudinal primary arms extends along entire longitudinal lengths of said adjacent individual longitudinal primary arms.

18. The hair brush according to claim 17 including first, second and third said individual longitudinal primary arms; and wherein a width of said longitudinal gap between respective intermediate spines of adjacent first and second individual longitudinal primary arms is greater than a width of said longitudinal gap between respective pairs of longitudinal rear spines of said adjacent first and second individual longitudinal primary arms and is greater than a width of said longitudinal gap between respective pairs of longitudinal forward spines of said adjacent first and second individual longitudinal primary arms; and wherein a width of said longitudinal gap between respective intermediate spines of adjacent second and third individual longitudinal primary arms is greater than a width of said longitudinal gap between respective pairs of longitudinal rear spines of said adjacent second and third individual longitudinal primary arms and is greater than a width of said longitudinal gap between respective pairs of longitudinal forward spines of said adjacent second and third individual longitudinal primary arms.

* * * * *